United States Patent [19]

Pitel

[11] 3,959,717

[45] May 25, 1976

[54] TEMPERATURE STABILIZED VOLTAGE REFERENCE CIRCUIT

[75] Inventor: Ira Jay Pitel, Williamsport, Pa.

[73] Assignee: GTE Sylvania Incorporated, Stamford, Conn.

[22] Filed: July 9, 1975

[21] Appl. No.: 594,277

[52] U.S. Cl. ..... 323/22 Z; 307/318; 323/69

[51] Int. Cl.[2] ..... G05F 3/14

[58] Field of Search ..... 323/22 Z, 68, 69; 307/302, 318

[56] References Cited

UNITED STATES PATENTS

| | | | |
|---|---|---|---|
| 3,634,751 | 1/1972 | Miller | 323/22 Z |
| 3,826,969 | 7/1974 | Eichelberger et al. | 323/22 Z |
| 3,882,372 | 5/1975 | Martynow et al. | 323/22 Z |

*Primary Examiner*—Gerald Goldberg
*Attorney, Agent, or Firm*—Norman J. O'Malley; Thomas H. Buffton; Robert T. Orner

[57] ABSTRACT

A very stable voltage reference potential is provided by circuitry wherein an avalanche device provides an output voltage which is, in turn, applied to a voltage to current converter to provide a current for the avalanche device which is dependent upon the output voltage rather than the voltage of the avalanche device.

8 Claims, 2 Drawing Figures

TEMPERATURE STABILIZED VOLTAGE REFERENCE CIRCUIT

BACKGROUND OF THE INVENTION

One of the known techniques for providing a stabilized voltage reference is to employ an avalanche device such as a zener diode having a relatively low voltage tolerance. Such zener diode devices are available, although rather costly, but require a current value having a relatively narrow tolerance. Thus, a relatively expensive adjustable resistor is usually series connected with the zener diode and adjusted to provide the desired current for the zener diode and to control the output voltage. Obviously, such apparatus is expensive, presents a repeatability problem due to resistance value adjustments, and requires inconvenient adjustments. Moreover, the zener diode current is dependent upon the diode voltage rather than the output voltage.

Another known technique for effecting a stabilized voltage reference is to employ a temperature controlled oven. Again, disadvantages such as thermal transients, heat dissipation, and increased package sizes are detrimental to such an approach.

OBJECTS AND SUMMARY OF THE INVENTION

An object of the present invention is to provide an enhanced temperature stabilized volage reference. Another object of the invention is to provide an improved temperature stabilized voltage reference which utilizes standard components. Still another object of the invention is to provide a desired output voltage from a temperature stabilized voltage reference utilizing a single adjustment.

These and other objects, advantages and capabilities are achieved in one aspect of the invention by circuitry which includes a first operational amplifier having an avalanche device means coupling an output terminal to a first input terminal, an adjustable first resistor coupling an output terminal to a second input terminal, and a voltage to current converter coupling the output terminal of the first operational amplifier means to the avalanche device means and first input terminal to the first operational amplifier means for providing a current for the avalanche device means which is dependent upon the output voltage of the first operational amplifier means.

PREFERRED EMBODIMENT OF THE INVENTION

For a better understanding of the present invention, together with other and further objects, advantages and capabilities thereof, reference is made to the following disclosure in conjuction with the accompanying drawings.

Figure 1:
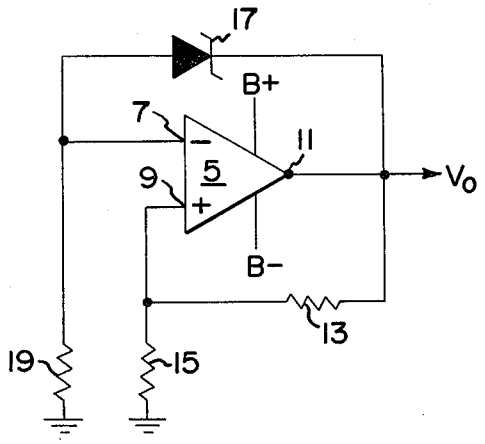
Fig. 1 PRIOR ART
FIG. 1 is a diagrammatic illustration of a prior art voltage reference circuit.

Referring to the drawings, the prior art embodiment of FIG. 1 illustrates a stabilized voltage reference circuit having an operational amplifier 5 with first and second input terminals, 7 and 9, and an output terminal 11. The output terminal 11 is coupled by a first resistor 13 to the second input terminal 9 of the operational amplifier 5. The second input terminal 9 and the first resistor 13 are connected to circuit ground by a second resistor 15.

A zener diode 17 couples the output terminal 11 to the first input terminal 7 of the operational amplifier 5. Also, a third or sampling resistor 19 connects the zener diode 17 and the first input terminal 7 of the operational amplifier to circuit ground.

As to operation, assume the prior art illustration of FIG. 1 has an output voltage $V_o$ which tends to go more positive. A feedback potential from the output voltage $V_o$ via the resistor 13 to the second input terminal 9 of the operational amplifier 5 forces the operational amplifier 5's output positive.

As the output voltage $V_o$ at the output terminal 11 continues to increase, the zener diode 17 starts to conduct causing current flow therethrough and development of a voltage drop across the sampling resistor 19. This voltage drop across the sampling resistor 19 is applied to the first input terminal 7 of the operational amplifier 5 and tends to force the output negative keeping the input voltages at the first and second input terminals 7 and 9 substantially equal.

However, it is to be noted that the output voltage $V_o$ is equal to the voltage drop across the zener diode 17 and the sampling resistor 19. More importantly, the zener current is proportioned to the zener voltage rather than the output voltage $V_o$ whereupon the manufacturers voltage tolerances for the zener diode are no longer obtainable.

Figure 2:
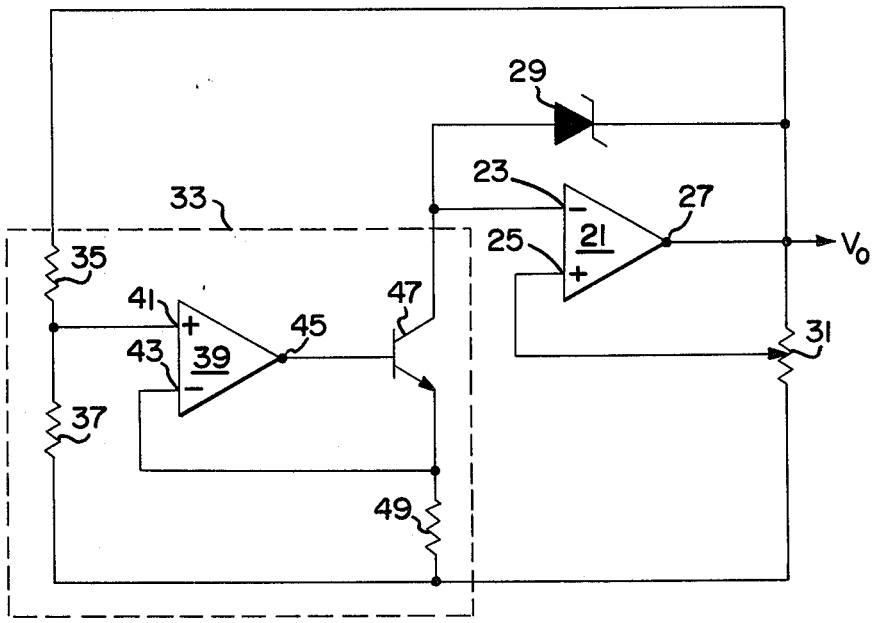
FIG. 2 is a diagrammatic illustration of a preferred embodiment of the invention.

Referring now to the preferred embodiment of FIG. 2, a temperature stabilized voltage reference circuit includes a first operational amplifier 21 having a first input terminal 23, a second input terminal 25, and an output terminal 27 whereat an output voltage $V_o$ is present. The first input terminal 23 and the output terminal 27 are interconnected by an avalanche device means such as a zener diode 29. An adjustable resistor 31 couples the second input terminal 25 and the output terminal 27 of the first operational amplifier 21.

A voltage to current converter means 33 includes a voltage divider having series connected resistors 35 and 37 connected to the output terminal 27 of the first operational amplifier 21 and to the adjustable resistor 31. A second operational amplifier 39 has first and second input terminals 41 and 43 and an output terminal 45.

The first input terminal 41 is coupled to the junction of the resistor 35 and 37 of the voltage divider and the output terminal 45 of the second operational amplifier 39 is coupled to the base of a transistor or current source 47. The emitter of the transistor 47 is connected back to the second input terminal 43 of the second operational amplifier 39 and to a sampling resistor 49 connected to the junction of the resistor 37 of the voltage divider and the adjustable resistor 31. The collector of the transistor 47 is connected to the first input terminal 23 of the first operational amplifier 21 and the zener diode 29.

As to operation, assuming an increase in the output voltage $V_o$ at the output terminal 27 of the first operational amplifier 21. The zener diode 29 will begin to conduct harder causing an increase in current flow through the transistor 47 and sampling resistor 49. The voltage fed back to the second input terminal 25 of the first operational amplifier 21 via the adjustable resistor 31 will increase at a slower rate than the potential fed back to the first input terminal 23 of the first operational amplifier 21. Thus, the output voltage $V_o$ will tend to return to the normal or fixed value as selected by the adjustable resistor 31.

Also, the previously mentioned increased conduction of the zener diode 29 causes an increased current flow through the transistor 47 and sampling resistor 49. Thus, an increased potential is applied to the second input terminal 43 of the second operational amplifier 39. At the same time, the increased output potential $V_o$ is applied to the voltage divider consisting of resistors 35 and 37 and provides a voltage at the first input terminal 41 of the second operational amplifier 39.

The voltage fed back to the first input terminal 41 is representative of the output voltage $V_o$ while the voltage fed back to the second input terminal 43 of the second operational amplifier 39 is representative of the current of the zener diode 29. Since these voltages must reach a point of equilibrium the current of the zener diode is proportional to the output voltage $V_o$.

Thus, there has been provided a unique temperature stabilized voltage reference circuit wherein the current of an avalanche device such as a zener diode is proportional to the output voltage of the circuit. Moreover, the output voltage of the circuit is readily altered by a single adjustable potentiometer without deleterious effect upon the tolerances of the obtainable stabilized potential.

While there has been shown and described what is at present considered a preferred embodiment of the invention, it will be obvious to those skilled in the art that various changes and modifications may be made therein without departing from the invention as defined by the appended claims.

What is claimed is:

1. A temperature stabilized voltage reference circuit comprising:

first operational amplifier means having first and second input terminals and an output terminal;

first resistor means connecting said output terminal to said second input terminal of said first operational amplifier means to effect stabilized operation thereof;

voltage to current converter means including a second operational amplifier means coupled to a current source means, said voltage to current converter means coupled to said output terminal and said first input terminal of said first operational amplifier means; and an avalanche device means coupled to said output terminal and first input terminal of said first operational amplifier means whereby a substantially constant current flows through said avalanche device and is a function of the output potential appearing at said output terminal of said first operational amplifier means.

2. The temperature stabilized voltage reference circuit of claim 1 wherein said first resistor means is an adjustable resistor for altering the level of the output potential appearing at the output terminal of said first operational amplifier means.

3. The temperature stabilized voltage reference circuit of claim 1 wherein said voltage to current converter means includes a voltage divider connected intermediate said output terminal of said first operational amplifier means and said first resistor means and to a first input terminal of said second operational amplifier means.

4. The temperature stabilized voltage reference circuit of claim 1 wherein said second operational amplifier means of said voltage to current converter means includes first and second input terminals and an output terminal and said current source means is in the form of an electron device having a first input electrode coupled to said output terminal and a second input electrode coupled to said second input terminal of said second operational amplifier means and an output electrode coupled to said first input terminal of said first operational amplifier means and to said avalanche device means.

5. The temperature stabilized voltage reference circuit of claim 1 wherein said voltage to current converter means includes a second resistor means coupled to said current source means and to a voltage divider connected to said first input terminal of said second operational amplifier means and to said output terminal of said first operational amplifier means.

6. A temperature stabilized voltage reference circuit comprising:

first operational amplifier means with first and second input terminals and an output terminal;

avalanche device means coupled to said first input and output terminals of said first operational amplifier means;

variable first resistor means coupled to said second input and output terminals of said first operational amplifier means; and voltage to current converter means including a voltage divider means coupled to said output terminal of said first operational amplifier means and to said variable first resistor means; second operational amplifier means operatively connected to said voltage divider means; and current source means operatively connected to said second operational amplifier means and intermediate said first input terminal of said first operational amplifier means and a second resistor coupled to said voltage divider means and said variable first resistor means.

7. The temperature stabilized voltage reference circuit of claim 6 wherein said avalanche device means is in the form of a zener diode.

8. The temperature stabilized voltage reference circuit of claim 6 wherein said second operational amplifier means of said voltage to current converter means includes first and second input terminals and an output terminal and said current source is in the form of a transistor having a base connected to said output terminal and an emitter connected to said second input terminal of said second operational amplifier means with a collector connected to said first input terminal of said first operational amplifier means.

* * * * *